US005983431A

United States Patent [19]

Meshulam

[11] Patent Number: 5,983,431

[45] Date of Patent: Nov. 16, 1999

[54] POOL BRUSH ATTACHMENT

[76] Inventor: Eli Meshulam, 3316 Mapu Pl., Kihei, Hi. 96753

[21] Appl. No.: 08/957,864

[22] Filed: Oct. 27, 1997

[51] Int. Cl.[6] ..... E04H 4/16

[52] U.S. Cl. ..... 15/1.7; 15/246; 114/222

[58] Field of Search ..... 15/1.7, 246; 114/222

[56] References Cited

U.S. PATENT DOCUMENTS

| | | | |
|---|---|---|---|
| 2,243,576 | 5/1941 | Otto | 15/160 |
| 3,003,168 | 10/1961 | Shouldice | 15/1.7 |
| 3,402,413 | 9/1968 | Gibellina | 15/246 |
| 4,637,087 | 1/1987 | Feinberg | 15/1.7 |
| 4,733,427 | 3/1988 | Conrad | 15/1.7 X |
| 4,742,592 | 5/1988 | Addona, Sr. | 15/1.7 |
| 4,783,868 | 11/1988 | O'Callaghan | 15/1.7 |
| 4,909,173 | 3/1990 | Strong | 15/1.7 X |
| 4,962,558 | 10/1990 | Harrell, Jr. | 15/1.7 |

*Primary Examiner*—Elizabeth McKane
*Attorney, Agent, or Firm*—James E. Brunton

[57] ABSTRACT

An attachment for a conventional swimming pool brush is disclosed, which is designed to continuously urge the bristles into engagement with the side wall of a pool using a novel, immovable hydrofoil. The hydrofoil comprises an upstanding fin having a plurality of flow apertures and is connected to a base portion by a plurality of triangularly shaped support members.

8 Claims, 2 Drawing Sheets

POOL BRUSH ATTACHMENT

BACKGROUND OF THE INVENTION

1. Field of the Invention

The present invention relates generally to cleaning brushes. More particularly, the invention concerns a novel swimming pool cleaning brush which is specially adapted to clean the side walls of a swimming pool.

2. Discussion of the Prior Art

In order to maintain a swimming pool in proper condition it is necessary to periodically clean the sides and bottom of the swimming pool. In the past, the sides of the swimming pool have been cleaned using an apparatus which comprises a brush that is attached to one end of a long handle which is gripped by the user. As a general rule, the handle is long enough for the user to move the head or brush portion of the apparatus along the side walls from the top of the pool to the bottom of the pool.

A major drawback of most prior art swimming pool cleaning apparatus resides in the fact that as the brush portion of the device is moved downwardly along the side wall, the force of the water acting on the brush tends to undesirably pull the cleaning bristles of the brush away from the wall. The thrust of the present invention is to provide an attachment for a conventional swimming pool cleaning apparatus that is so constructed and arranged, that as the brush is pushed downwardly along the side wall of the pool, the water acting against the attachment will cause the brush to be forced in a direction toward the pool wall. Advantageously, the attachment of the invention can be made in several sizes and can be specially pre-drilled to accommodate the fasteners which are used to interconnect the handle portion of the brush with the brush or bristle portion of the device.

SUMMARY OF THE INVENTION

It is object of the present invention to provide an attachment for a conventional swimming pool wall cleaning apparatus which is uniquely designed to continuously urge the bristles of the brush portion of the apparatus into flush engagement with the side wall of the pool as the brush is moved downwardly along the vertical side wall portions of the swimming pool.

Another object of the invention is to provide an attachment of the aforementioned character which is of simple construction and is readily attachable to conventional swimming pool wall cleaning brushes.

Another object of the invention is to provide an attachment as described in the preceding paragraphs which is of simple design, is lightweight and extremely durable in operation.

Another object of the invention is to provide an attachment for a swimming pool cleaning apparatus which embodies no moving parts and one which can be fabricated at very low cost in large volume.

DESCRIPTION OF THE INVENTION

Figure 1:
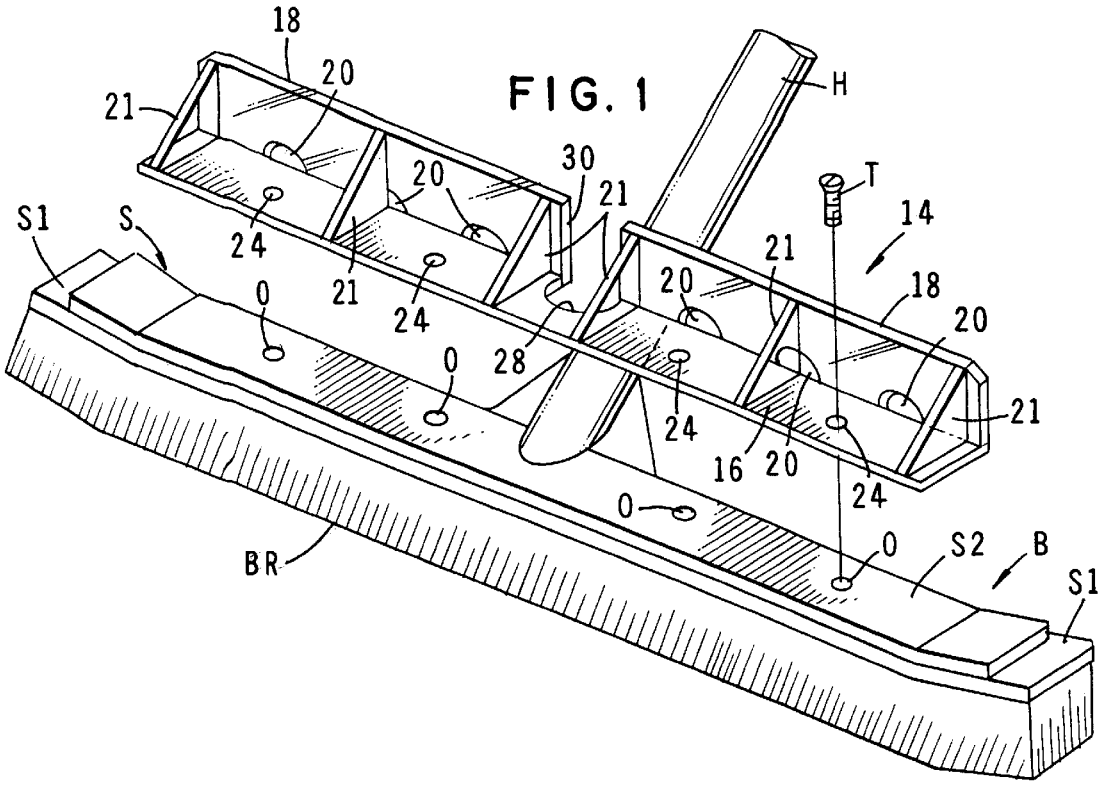
FIG. 1 is a generally perspective view of one form of the swimming pool wall brush attachment of the present invention shown exploded from the wall brush.
Figure 3:
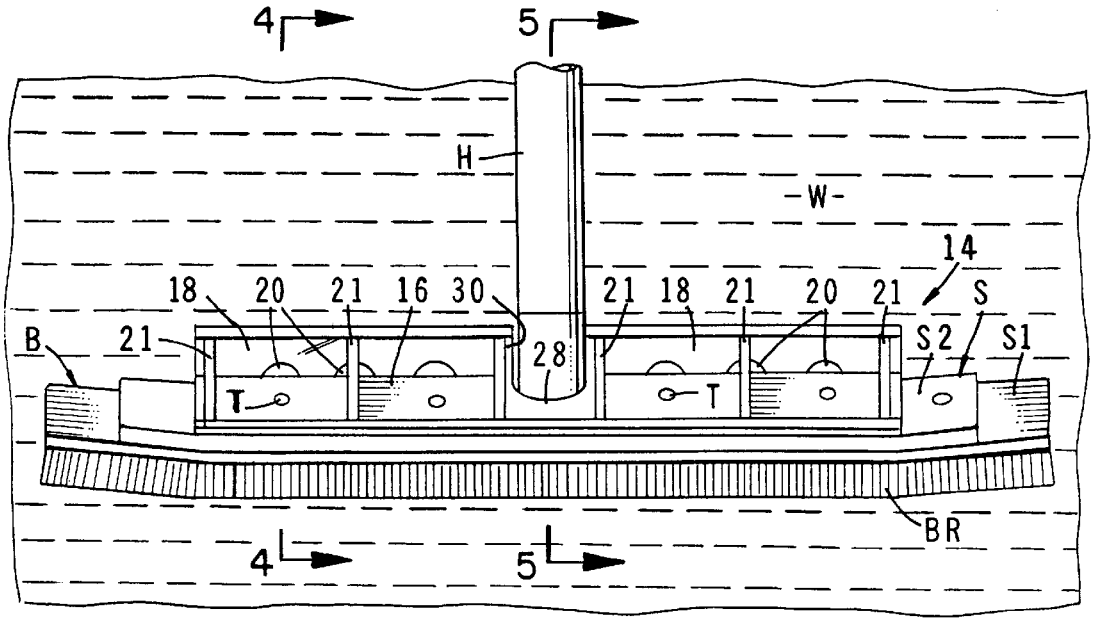
FIG. 3 is a greatly enlarged view taken along lines 3—3 of FIG. 2.
Figure 2:
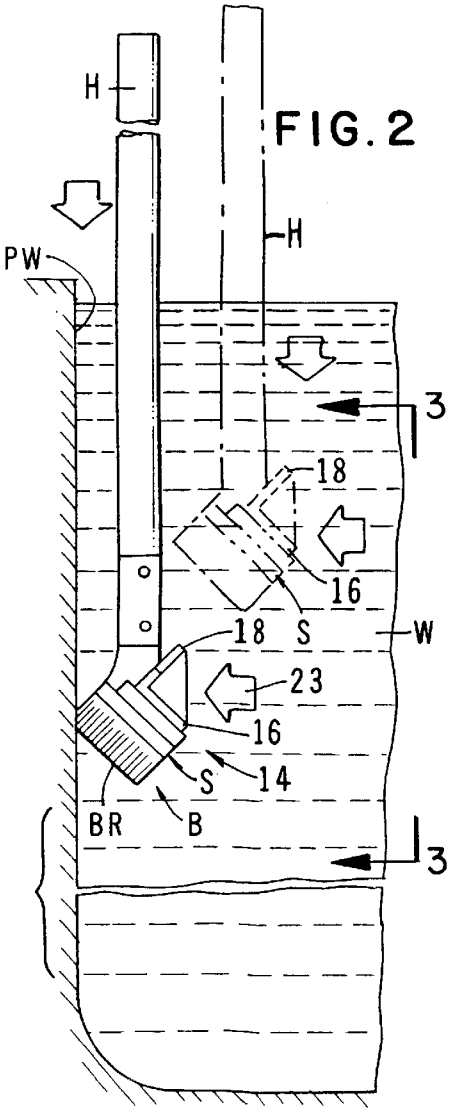
FIG. 2 is a generally diagrammatic view illustrating the manner of operation of a prior art swimming pool cleaning apparatus which has the attachment of the present invention connected thereto.

Referring to the drawings, and particularly FIGS. 1, 2 and 3, one form of the attachment for a swimming pool wall cleaning apparatus of the present invention is there illustrated and generally designated by the numeral 14. Attachment 14 is adapted to be interconnected with a conventional swimming pool wall cleaning apparatus of the character having an elongated handle "H" to which a wall cleaning brush assembly "B" is attached in the manner best seen in FIG. 1. Brush assembly "B" includes a support assembly "S" which includes a support "S1" to which the bristles of the brush "BR" are attached. When the conventional swimming pool wall cleaning brush made up of handle "H", support assembly "S" and bristles "BR" is used to clean the side walls of a swimming pool, a downward pressure exherted on the handle "H" tends to cause the bristles of the brush to move undesirably away from, rather than toward the wall of the swimming pool being cleaned. This is highly annoying to the user of the apparatus and can present substantial difficulties, particularly when the apparatus is being used to clean the deep end of the pool. It is this problem that the present invention seeks to solve.

As best seen in FIG. 1, one form of the attachment 14 of the present invention comprises a base portion 16 and a uniquely configured hydra-foil means which is connected to base 16 and functions to continuously urge the bristles of the brush into cleaning engagement with the wall of the swimming pool as the wall cleaning portion of the apparatus is moved downwardly along the wall of the swimming pool in the manner illustrated in the solid lines of FIG. 2. This novel hydra-foil means here comprises an upstanding fin member 18 which is affixed to base portion 16 and extends angularly therefrom in the manner shown in the drawings. Upstanding fin 18 is provided with a plurality of transversely spaced apart, generally semi-circular shaped openings or flow apertures 20. In a manner presently to be described these flow apertures cause the water in the swimming pool to flow through the hydra-foil means in a manner to continuously urge the brush portion of the apparatus toward the side wall of the pool in the direction indicated by the arrow 23 of FIG. 2. A plurality of generally trangularly shaped, spaced apart support members 21 interconnect base 16 with fin 18 to provide stability to fin 18.

Figure 4:
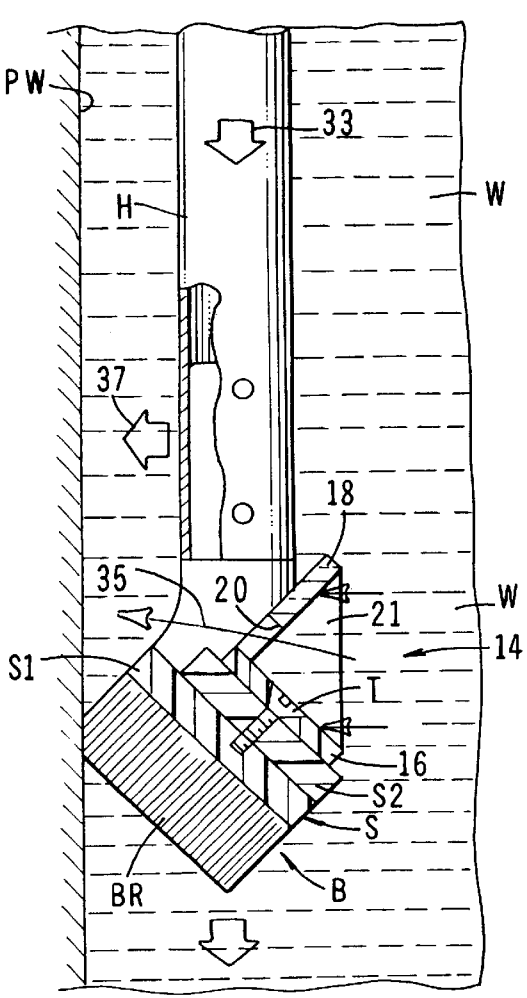
FIG. 4 is an enlarged, cross-sectional view taken along lines 4—4 of FIG. 3, further illustrating the manner of operation of the swimming pool cleaning apparatus after the attachment of the present invention has been connected thereto.

As best seen in FIGS. 1 and 4, connector means are provided for attaching the base portion 16 of the attachment of the invention to the upper portion of the support assembly of the swimming pool wall cleaning brush. In the present form of the invention the support assembly "S" comprises the previously identified, bristle support member "S1" and a transversely extending metal support plate "S2". Typically, bristle support member "S1" is constructed from either wood or plastic and the metal upper member "S2" is connected thereto by a plurality of connectors such as threaded screws "T" (FIG. 1). For this purpose, member "S2" is provided with a plurality of transversely spaced apart screw receiving openings "O" so that the attachment of the present invention can be quickly and easily connected to the conventional swimming pool wall cleaning apparatus without the necessity of modifying the pool cleaning apparatus. As indicated in the drawings, base member 16 of the attachment is provided with a plurality of transversely spaced apart holes 24 which can be aligned with holes or opening "O" provided in upper plate "S2". With this novel construction, the attachment of the present invention can be interconnected with a conventional swimming pool wall cleaning apparatus by simply removing the threaded fasteners "T" from the support assembly "S", positioning the attachment over support plate S2 so that holes 24 index with openings "O" and then connecting the attachment to the support assembly using either the existing threaded connectors "T" or, if necessary, slightly longer connectors.

To insure proper alignment of the attachment of the invention with the support assembly of the swimming pool wall cleaning apparatus, base portion 16 is provided with a generally "U" shaped opening 28 which closely receives the lower portion of the handle "H". Similarly, fin 18 is provided with an opening 30 which accepts handle "H" during interconnection of the attachment of the invention with the swimming pool wall cleaning apparatus.

Figure 5:
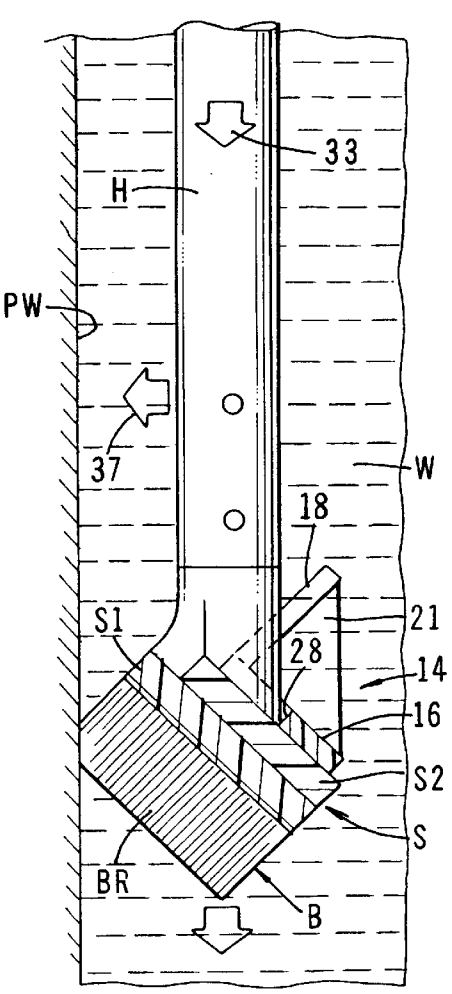
FIG. 5 is an enlarged, cross-sectional view taken along lines 5—5 of FIG. 3.

Once the attachment of the invention is properly interconnected with the support assembly of the pool cleaning apparatus in the manner shown in FIGS. 4 and 5, a downward movement of the cleaning brush along the walls of the pool in the direction of the arrow 33 of FIG. 4 will cause water "W" within the pool to flow through flow apertures 20 in the direction of the arrow 35 of FIG. 4. Because of the strategic configuration and positioning of the attachment of the invention, this water flow will continuously urge the wall cleaning brush toward the swimming pool wall "PW" as indicated by the arrow 37 in FIG. 4. Accordingly, with each downward thrust of the pool wall cleaning apparatus, the novel hydra-foil means of the invention will counter the tendency of the brush to move away from the swimming pool wall and will, in fact, create positive forces tending to continuously urge the bristles "BR" of the brush assembly into firm cleaning engagement with the surface of the swimming pool wall "PW".

Having now described the invention in detail in accordance with the requirements of the patent statutes, those skilled in this art will have no difficulty in making changes and modifications in the individual parts or their relative assembly in order to meet specific requirements or conditions. Such changes and modifications may be made with out departing from the scope and spirit of the invention, as set forth in the following claims.

I claim:

1. An attachment for a swimming pool wall cleaning apparatus for cleaning the walls of a water filled swimming pool, said apparatus being of the character having an elongated handle to which a wall cleaning brush is connected, the brush including a bristle support assembly having an upper surface and a lower surface to which the bristles of the brush are attached for movement along the wall of the swimming pool, said attachment comprising:

(a) a base portion;

(b) connector means for attaching said base portion to the upper surface of the bristle support assembly of the brush;

(c) hydra-foil means connected to said base portion for urging the brush into cleaning engagement with the wall of the swimming pool as the brush is moved through the water and downwardly along the wall of the swimming pool, said hydra foil means comprising an upstanding fin connected to said base portion, said upstanding fin having a plurality of flow apertures formed therein for causing a portion of the water in the pool to flow in a direction toward the wall of the pool as the wall cleaning brush is moved downwardly along the wall of the pool; and (d) a plurality of generally triangularly shaped support members disposed in a spaced apart relationship along said base portion for interconnecting said base portion with said upstanding fin.

2. An attachment as defined in claim 1, in which said base portion is provided with a generally "U" shaped cut out for closely receiving the elongated handle portion of the swimming pool wall cleaning apparatus.

3. An attachment as defined in claim 1, in which said upstanding fin extends substantially perpendicularly to said base wall.

4. A swimming pool brush for use in cleaning the walls of a swimming pool filled with water comprising:

(a) an elongated handle;

(b) A brush assembly connected to said elongated handle; said brush assembly comprising:

(i) a bristle support assembly including a bristle support member having an upper surface and a lower surface; and (ii) cleaning bristles connected to and extending from said lower surface of said bristle support member;

(c) an attachment connected to said upper surface of said support assemble of said brush assembly, said attachment comprising:

(i) a generally planar base portion;

(ii) connector means for attaching said generally planar base portion to said bristle support member; and (iii) an upstanding fin immovably connected to said generally planar base portion and extending generally perpendicularly therefrom, said upstanding fin having a plurality of unobstructed apertures therethrough, said immovable fin being acted upon by the water within the swimming pool as said brush assembly is moved downwardly along the wall of the swimming pool in a manner to impart force to said brush assembly tending to urge said cleaning bristles thereof into engagement with the swimming pool wall.

5. A swimming pool brush as defined in claim 4 in which said plurality of unobstructed apertures are so constructed and arranged to direct a portion of the water in the swimming pool toward the swimming pool wall as the brush assembly is moved downwardly through the water and along a wall of the swimming pool.

6. A swimming pool brush for use in cleaning the walls of a swimming pool filled with water comprising:

(a) an elongated handle;

(b) brush assembly connected to said elongated handle, said brush assembly comprising:

(i) a bristle support assembly, including a bristle support member having an upper surface and a lower surface; and (ii) cleaning bristles connected to and extending from said lower surface of said bristle support member;

(c) an attachment connected to said upper surface of said support member of said brush assembly, said attachment comprising:

(i) a generally planar base portion;

(ii)connector means for attaching said generally planar base portion to said bristle support member; and (iii) an upstanding fin fixedly and immovably connected to said generally planar base portion and extending generally perpendicularly therefrom, said fin having a plurality of transversely spaced apart flow apertures formed therein, said apertures being so arranged that when said brush assembly is moved downwardly along the wall of the swimming pool forces are imparted to said brush assembly tending to urge said cleaning bristles thereof into engagement with the swimming pool wall.

7. A swimming pool brush as defined in claim 6 in which said flow apertures are arranged to direct a portion of the water in the swimming pool through said apertures in a direction toward the swimming pool wall as the brush assembly is moved downwardly through the water and along a wall of the swimming pool.

8. A swimming pool brush as defined in claim 6 in which said generally planar base portion and said upstanding fin are provided with open rings to receive said elongated handle.

* * * * *